US006093263A

United States Patent [19]

Kobayashi et al.

[11] Patent Number: 6,093,263

[45] Date of Patent: Jul. 25, 2000

[54] SOFT NITRIDED GEAR AND METHOD OF FABRICATING THE SAME

[75] Inventors: Keizo Kobayashi; Kazunori Ishikawa; Kazuhisa Ozaki; Toshihiro Tomino; Mikio Iwase; Hiroshi Kato; Tatsuo Tozuka, all of Anjo; Atsushi Tabata, Toyota; Kagenori Fukumura, Toyota; Yasuo Hojo, Toyota; Shoichi Sayo, Toyota; Hideki Miyata, Toyota, all of Japan

[73] Assignees: Aisin AW Co., Ltd., Anjo; Toyota Jidosha Kabushiki Kaisha, Aichi-ken, both of Japan

[21] Appl. No.: 09/104,224

[22] Filed: Jun. 25, 1998

[30] Foreign Application Priority Data

Jun. 30, 1997 [JP] Japan ..... 9-175025
Mar. 19, 1998 [JP] Japan ..... 10-070830

[51] Int. Cl.[7] ..... C22C 38/22; C22C 38/24; C23C 8/26; C21D 1/06

[52] U.S. Cl. ..... 148/318; 148/230; 148/228

[58] Field of Search ..... 148/230, 228, 148/318

[56] References Cited

U.S. PATENT DOCUMENTS 4,531,984 7/1985 Madsac et al. ..... 148/320

*Primary Examiner*—Deborah Yee
*Attorney, Agent, or Firm*—Oliff & Berridge, PLC

[57] ABSTRACT

A gear having high pitching resistance, sufficient surface hardness, sufficient hardened depth, high abrasion resistance, high breakage resistance, high fatigue resistance, and low gear noises. A material equivalent to JIS-SCM420 is soft nitrided for two hours in a mixture gas containing 45 to 65 volume % of residual $NH_3$ at a gas temperature of 530 to 565° C., thus producing a compound layer having a hardness equal to or higher than that of the material plus Hv 50 and a thickness of 200 $\mu$m or more.

19 Claims, 4 Drawing Sheets

FIG. 3

| SAMPLE | GAS CONCENTRATION (%) | GAS TEMPERATURE (℃) | HEAT PATTERN | | | THICKNESS OF COMPOUND LAYER (μm) | THICKNESS OF DIFFUSION LAYER (μm) (HARDNESS : EQUAL TO OR MORE THAN INSIDE HARDNESS OF THE MATERIAL PLUS 50 Hv) | ACCEPTABILITY |
|---|---|---|---|---|---|---|---|---|
| No. | RESIDUAL $NH_3$ ($CO_2$ + $NH_3$) | | 1-STAGE (2 hrs) | 2-STAGES (2 hrs + 1 hr) | 1-STAGE (1.5 hrs) | TARGET : 12 μm OR LESS | TARGET : 200 μm OR MORE | |
| 1 | 50 | 590 | | ○ | | 20 | 370 | × |
| 2 | 50 | 570 | | ○ | | 5 | 190 | × |
| 3 | 60 | 550 | | ○ | | 7.5 | 330 | ○ |
| 4 | 60 | 570 | | ○ | | 17.5 | 330 | × |
| 5 | 60 | 530 | ○ | | | 4 | 180 | × |
| 6 | 60 | 550 | ○ | | | 10 | 200 | ○ |
| 7 | 57 | 550 | ○ | | | 7.5 | 200 | ○ |
| 8 | 52 | 550 | ○ | | | 8 | 200 | ○ |
| 9 | 52 | 570 | ○ | | | 12.5 | 220 | × |
| 10 | 52 | 570 | ○ | | | 12.5 | 250 | × |
| 11 | 60 | 550 | ○ | | | 10 | 210 | ○ |
| 12 | 52 | 570 | | | ○ | 12.5 | 220 | × |
| 13 | 50 | 560 | ○ | | | 10 | 230 | ○ |
| 14 | 55 | 560 | ○ | | | 11 | 230 | ○ |

FIG. 4

| SAMPLE | GAS CONCENTRATION (%) | GAS TEMPERATURE (℃) | HEAT PATTERN | | | THICKNESS OF COMPOUND LAYER (μm) | THICKNESS OF DIFFUSION LAYER (μm) (HARDNESS : EQUAL TO OR MORE THAN INSIDE HARDNESS OF THE MATERIAL PLUS 50 Hv) | ACCEPTABILITY |
|---|---|---|---|---|---|---|---|---|
| No. | RESIDUAL $NH_3$ ($CO_2$ + $NH_3$) | | 1-STAGE (2 hrs) | 2-STAGES (2 hrs + 1 hr) | 1-STAGE (1.5 hrs) | TARGET : 12 μm OR LESS | TARGET : 200 μm OR MORE | |
| 1 | 52 | 560 | ○ | | | 10 | 250 | ○ |
| 2 | 52 | 570 | ○ | | | 9 | 230 | ○ |
| 3 | 52 | 570 | | | ○ | 11 | 250 | ○ |
| 4 | 55 | 550 | ○ | | | 4 | 210 | ○ |
| 5 | 57 | 550 | ○ | | | 9 | 210 | ○ |
| 6 | 57 | 560 | ○ | | | 11 | 230 | ○ |
| 7 | 60 | 550 | ○ | | | 9 | 200 | ○ |
| 8 | 50 | 570 | | ○ | | 5 | 180 | × |
| 9 | 50 | 570 | | ○ | | 5 | 190 | × |
| 10 | 50 | 590 | | ○ | | 15 | 360 | × |
| 11 | 55 | 530 | | ○ | | 5 | 180 | × |
| 12 | 60 | 570 | | ○ | | 15 | 280 | × |
| 13 | 55 | 550 | | ○ | | 11 | 280 | ○ |
| 14 | 60 | 550 | | ○ | | 4 | 250 | ○ |

SOFT NITRIDED GEAR AND METHOD OF FABRICATING THE SAME

INCORPORATION BY REFERENCE

The disclosures of the following priority applications are herein incorporated by reference:

Japanese Patent Application No. 9-175025 filed Jun. 30, 1997, and

Japanese Patent Application No. 10-070830 filed Mar. 19, 1998.

BACKGROUND OF THE INVENTION

1. Field of Invention

The present invention relates to a soft nitrided gear and a method for fabricating the same, or more particularly to a nitrided gear having a comparatively thin compound layer and a comparatively thick diffusion layer and a method of fabricating the same.

2. Description of Related Art

Generally, high-strength gears, especially gears used for an automatic transmission, require a high abrasion resistance and a high strength. Of all such gears, a ring gear coupled to an input shaft or an output shaft of a planetary gear has such a length of action (the number of teeth in mesh per output rotation) that it has a considerable effect on the gear noises.

Conventional gears are known that are intended for a higher surface abrasion resistance, a higher breakage resistance and a higher fatigue resistance to further improve the dimensional accuracy by reducing thermal strain. An example is disclosed in JP-A-8-165556, in which a gear made of steel containing C, Si, Mn, Cr, Mo, Al, N and V is soft nitrided with a gas having a gas volume composition ratio of $RX/NH_3$ ranging from 0.5 to 1.5 at a processing temperature ranging from 550 to 650 ° C., followed by forming a porous layer having a thickness of 10 $\mu$m or less. The RX gas has the composition 23 vol. % CO, 30 vol. % $H_2$ and 47 vol. % $N_2$.

As a result, a sufficient surface hardness and a sufficient hardened depth are obtained, and at the same time the thickness of the porous layer is limited such that the problem of separation of the outermost compound layer (reduction in pitching resistance) can be solved.

The porous layer of the above-mentioned conventional gear, however, is as thick as 10 $\mu$m. Accordingly once the porous layer is separated, the surface of the gear (meshed surface) tends to become rough to a comparatively high degree, which may deteriorate (increase) gear noises.

In view of this, the object of the present invention is to provide a gear and a method of fabricating the gear in which the porous layer is suppressed as far as possible while maintaining a diffused layer by selecting specific soft nitriding conditions, and a sufficient pitching resistance, a sufficient surface hardness and a sufficient hardened depth are obtained to secure an abrasion resistance, a breakage resistance and a fatigue resistance, while at the same time suppressing further deterioration of gear noises.

SUMMARY OF THE INVENTION

According to a first aspect of the invention, there is provided a gear formed by gas soft nitriding a steel containing, by weight %, 0.18 to 0.23 of C, 0.15 to 0.35 of Si, 0.60 to 0.85 of Mn, 0.03 or less of P, 0.03 or less of S, 0.90 to 1.20 of Cr and 0.15 to 0.30 of Mo, with Fe and impurities as a residual. The gear includes a compound layer containing N and Fe having a thickness of 2 to 12 $\mu$m on a tooth flank surface thereof and a diffusion layer formed under the compound layer having a thickness of 200 $\mu$m or more and having a hardness equal to or higher than that of the steel plus Hv 50.

According to a second aspect of the invention, there is provided a gear formed by gas soft nitriding a steel containing, by weight %, 0.16 to 0.21 of C, 0.15 to 0.35 of Si, 0.55 to 0.90 of Mn, 0.03 or less of P, 0.03 or less of S, 0.3 or less of Cu, 0.25 or less of Ni, 0.90 to 1.10 of Cr, 0.07 to 0.13 of Al and 0.10 to 0.15 of V, with Fe and impurities as a residual. The gear includes a compound layer containing N and Fe having a thickness of 2 to 12 $\mu$m on a tooth flank surface thereof and a diffusion layer formed under the compound layer having a thickness of 200 $\mu$m or more and having a hardness equal to or higher than that of the steel plus Hv 50.

According to a third aspect of the invention, there is provided a gear used for an automatic transmission.

According to a fourth aspect of the invention, there is provided a gear coupled to an input shaft or an output shaft of a planetary gear unit of the automatic transmission.

According to a fifth aspect of the invention, there is provided a method of fabricating a gear, including the steps of forming a gear stock of steel containing, by weight %, 0.18 to 0.23 of C, 0.15 to 0.35 of Si, 0.60 to 0.85 of Mn, 0.03 or less of P, 0.03 or less of S, 0.90 to 1.20 of Cr and 0.15 to 0.30 of Mo, with Fe and impurities as residual; and soft nitriding the gear stock for a predetermined length of time in a mixture gas atmosphere containing 45 to 65 volume % of residual $NH_3$ at a gas temperature of 530 to 565° C.

According to a sixth aspect of the invention, there is provided a method of fabricating a gear in which residual $NH_3$ concentration of the mixture gas ranges from 45 to 60 volume % and gas temperature ranges from 555 to 565° C.

According to a seventh aspect of the invention, there is provided a method of fabricating a gear including the steps of first-stage soft nitriding in the mixture gas containing 55 to 65 volume % of residual $NH_3$ at temperature of 545 to 555° C; and second-stage soft nitriding in the mixture gas containing 15 to 25 volume % of residual $NH_3$ at gas temperature of 585 to 595° C.

According to an eighth aspect of the invention, there is provided a method of fabricating a gear, including the steps of forming a gear stock of a steel containing, by weight %, 0.16 to 0.21 of C, 0.15 to 0.35 of Si, 0.55 to 0.90 of Mn, 0.03 or less of P, 0.03 or less of S, 0.3 or less of Cu, 0.25 or less of Ni, 0.90 to 1.10 of Cr, 0.07 to 0.13 of Al and 0.10 to 0.15 of V, with Fe and impurities as residual; and soft nitriding the gear stock for a predetermined length of time in a mixture gas atmosphere containing 45 to 65 volume % of residual $NH_3$ at temperature of 540 to 580° C.

According to a ninth aspect of the invention, there is provided a method of fabricating a gear including the steps of first-stage soft nitriding in the mixture gas containing 50 to 60 volume % of residual $NH_3$ at temperature of 540 to 560° C.; and second-stage soft nitriding in the mixture gas containing 15 to 25 volume % of residual $NH_3$ at temperature of 585 to 595° C.

The gear according to this invention has the tooth surface formed with a compound layer containing N and Fe. This compound layer is hard enough to improve abrasion resistance. The compound layer has a small thickness ranging form 2 to 12 μm. Also a porous layer having a small thickness limited as much as possible is formed on the compound layer. Even when the porous layer is separated, the resultant roughness formed on meshed tooth surface may be negligible. Therefore the gear noise is not affected. The compound layer having a thickness of 2 μm or less fails to exhibit a sufficient abrasion-resistance performance. Meanwhile when the compound layer has a thickness of 12 μm or more, a considerable roughness is formed on the gear surface accompanied with separation of the porous layer. The gear noises, thus, are further adversely affected.

Also, the gear is provided with a nitrogen diffusion layer under the compound layer. The diffusion layer is comparatively hard and tenacious, and therefore has high breakage resistance and strength. In addition, compressive stress is left in the diffusion layer due to the volume expansion, resulting in improved fatigue resistance. The diffusion layer having a hardness equal to or less than that of the steel (after heat treatment) plus Hv 50 and a thickness of 20 μm or less cannot exhibit a sufficient breakage resistance, strength or fatigue resistance when it is applied to gears, especially, those for the automatic transmission.

A predetermined material is heat treated and cut into a gear stock. This gear stock is nitrided using the gas soft nitriding method. In the process, the residual $NH_3$ concentration in the mixture gas, the gas temperature and the processing time are appropriately selected so that a comparatively thin compound layer and a comparatively thick diffusion layer are formed on the gear surface.

In the first or second aspect of the invention, a sufficient abrasion resistance can be maintained in spite of decrease in the thickness of the compound layer, and the gear noises are not affected in spite of separation of the porous layer. Also, a comparatively deep diffusion layer can be obtained with a predetermined hardness or more. Therefore, both a breakage resistance and a fatigue resistance can be secured, and a high performance can be obtained as a gear used in the automatic transmission.

In the third aspect of the invention, requirements of the automatic transmission such as quietness, compactness and endurance match well with the gear according to the present invention, which is superior in abrasion resistance, breakage resistance and pitching resistance, exhibits low thermal strain and capable of reducing the gear noises.

In the fourth aspect of the invention, the use of the gear according to this invention, for example, as a ring gear coupled to the input shaft or the output shaft with a long length of action of the planetary gear unit of the Simpson type can reduce noises considerably, especially at a low shift-speed.

In the fifth or eighth aspect of the invention, a comparatively thin compound layer and a comparatively thick diffusion layer can be produced by gas soft nitriding under proper conditions. High machinability of the stock-forming material derived from repeatedly processible gas nitriding makes it possible to mass produce the aforementioned high-performance gears easily and at a comparatively low cost.

In the sixth aspect of the invention, a deeper diffusion layer can be formed while keeping a compound layer thin, thereby improving the breakage resistance and the fatigue resistance of the gear.

In the seventh or ninth aspect of the invention, the 2-stage nitriding can produce a further deeper diffusion layer while keeping the compound layer thin.

BRIEF DESCRIPTION OF THE DRAWINGS

FIG. 3 is a Table showing results of experiments conducted using a material 1 shown in Table 1 by the gas soft nitriding method under various conditions.

FIG. 4 is a Table showing results of experiments conducted using a material 2 shown in Table 2 by the gas soft nitriding method under various conditions.

DETAILED DESCRIPTION OF PREFERRED EMBODIMENTS

Figure 1:
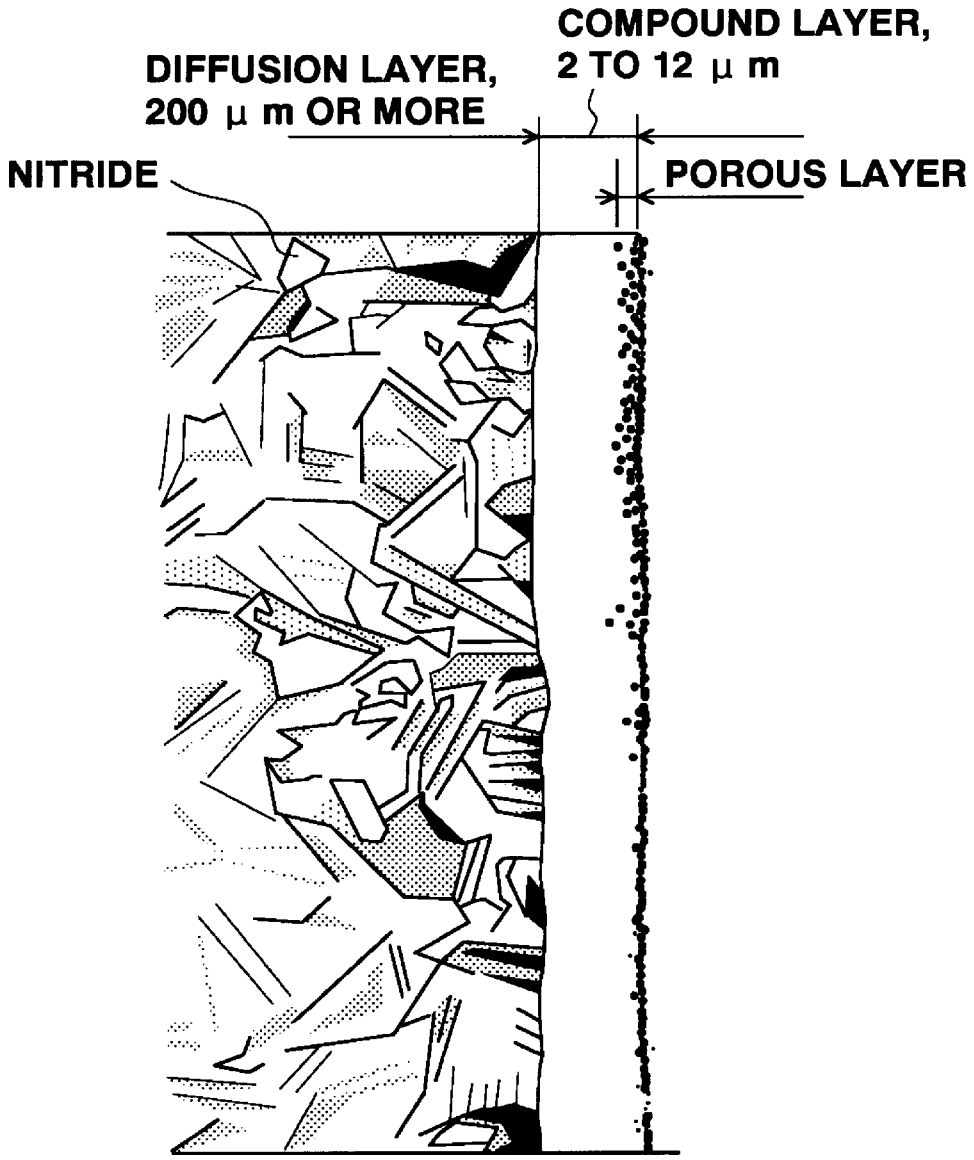
FIG. 1 is a diagram schematically showing a metal structure of the gear surface according to the present invention.

FIG. 1 is a model diagram schematically showing an enlarged microphotograph of a gear surface (tooth surface) according to an embodiment of the invention. The surface of the gear is composed of a layer of N—Fe compound such as $Fe_3N$ (ε), $Fe_4N$ (γ'), etc. The outermost surface over the compound layer is formed as a very thin porous layer containing an oxide. The thickness of the compound layer including the porous layer ranges from 2 to 12 μm.

A diffusion layer having a nitride diffused into a solid solution of FeC is formed under the compound layer. This diffusion layer has a hardness that is equal to or higher than that of the stock (steel) immediately after heat treatment plus Hv 50 and has a depth of 200 μm or more. The diffusion layer is formed on a heat treated base material of the stock.

Now, a method of fabricating the gear will be explained. A material 1 is composed of an alloy steel, and specifically, steel conforming to JIS-SCM420, the entire disclosure of which is incorporated herein by reference. Table 1 shows the composition of the material 1.

TABLE 1

| Chemical composition of material 1 (%) | | | | | | |
|---|---|---|---|---|---|---|
| C | Si | Mn | Cr | Mo | P | S |
| 0.18~0.23 | 0.15~0.35 | 0.60~0.85 | 0.90~1.20 | 0.15~0.30 | 0.03 or less | 0.03 or less |

Meanwhile a material 2 is developed for application of the gear according to the invention, and has the composition shown in Table 2.

TABLE 2

| Chemical composition of material 2 (%) | | | | | | | | | |
|---|---|---|---|---|---|---|---|---|---|
| C | Si | Mn | Cr | Al | V | Ni | Cu | P | S |
| 0.16~0.21 | 0.015~0.35 | 0.65~0.90 | 0.90~1.10 | 0.07~0.13 | 0.10~0.15 | 0.25 or less | 0.30 or less | 0.03 or less | 0.03 or less |

Being heat treated, the material 1 or 2 was formed into the shape of a gear through the gear cutting process. The resultant gear stock in the shape of gear was soft nitrided by the gas soft nitriding method.

A mixture gas ($CO_2$+$NH_3$) containing $CO_2$ and $NH_3$ as a nitride gas was used for the process. The mixture gas has a residual $NH_3$ concentration ranging from 45 to 65 volume %, and preferably from 45 to 60 volume %. The temperature of the mixture gas ranged from 530 to 565° C. for the material 1 and from 540 to 580° C. for the material 2, and preferably from 555 to 566° C. The normal processing time was two hours for a 1-stage process. Alternatively, a second stage can be added to the 1-stage process.

In this case, as for the material 1, the processing time was two hours with the residual $NH_3$ concentration of 55 to 65 volume % at the gas temperature of 545 to 555° C. for the first stage, and the processing time at the second stage was one hour with the residual $NH_3$ concentration of 15 to 25 volume % at the gas temperature of 585 to 595° C. As for the material 2, on the other hand, the processing time was two hours with the residual $NH_3$ concentration of 50 to 65 volume % at the gas temperature of 540 to 560° C. at the first stage, and at the second stage, the processing time was one hour with the residual $NH_3$ concentration of 15 to 25 volume % at the gas temperature of 585 to 595° C.

The above-mentioned process produced a gear with the tooth surface thereof formed with a compound layer ranging from 2 to 12 $\mu$m and a diffusion layer having a hardness that is equal to or higher than that of the steel plus Hv 50 and depth of 200 $\mu$m or more. This gear is formed with a very hard compound layer on the surface thereof, and therefore has a high abrasion resistance. Also, since the compound layer is comparatively thin, the porous layer is prevented from being separated. Even if separated, the resultant roughness on the tooth surface is negligible. This serves to reduce the gear noise in combination with the low thermal strain caused by the soft nitriding at a comparatively low temperature.

This gear is used as a ring gear coupled to the input shaft or the output shaft of the planetary gear unit, particularly of the Simpson type. However, The gear of the present invention is useful in other applications that will be apparent to one of ordinary skill in the art.

Due to long length of action at a low shift speed, the ring gear tends to give an adverse effect on the gear noise, abrasion and fatigue to a great degree. These problems, however, can be overcome by employing the gear of the present invention exhibiting excellent characteristics.

In the nitriding process for the materials 1 and 2 as described above, each element constituting the materials functions as follows.

Carbon is an element required for securing an appropriate hardenability and thus securing a predetermined hardness of the core. For this requirement to be met, the content of this element is required to be 0.15 wt % or more. In the case where the content of this element exceeds 0.50 wt %, the hardenability is increased, and the tenacity is reduced, resulting in deteriorated machinability. In relation with contents of other elements, the carbon content was set to 0.18 to 0.23 wt % for the material 1, and 0.16 to 0.21 wt % for the material 2.

Silicon is added as a deoxidizing agent and to strengthen the solid solution. When the content of this element exceeds 1.20 wt %, the tenacity and the machinability are deteriorated. The preferred content, therefore, is 1.20 wt % or less. In relation with contents of other elements, the content was set to 0.15 to 0.35 wt % for both materials 1 and 2.

Manganese is an element indispensable as a deoxidizing agent and is also effective for securing the core strength. For a sufficient core strength to be secured, the content is required to be 0.55 wt % or more in relation with contents of other component elements. The content exceeding 1.30 wt % adversely affects the workability and the machinability. Therefore the content was set to 0.60 to 0.85 wt % for the material 1, and 0.55 to 0.90 wt % for the material 2.

Chromium improves the core strength, and in the soft nitriding process, as the amount of added Cr increases, the surface hardness and the hardened depth are enhanced correspondingly. When Cr content is less than 0.70 wt %, neither the nitriding effect nor the core strength is improved. Meanwhile if Cr content exceeds 1.50 wt %, a firm soft nitride layer is formed on the surface at the sacrifice of the hardened depth. Cr content was set to 0.90 to 1.20 wt % for the material 1 and the material 2 in relation with other content of component elements.

Molybdenum is an effective element for securing a superior hardenability and improving the tenacity at the same time. A content of more than 0.50 wt %, however, reaches the limit of the effects. In relation with contents of other components, therefore, the content ranging from 0.15 to 0.30 wt % was set for the material 1.

Aluminum is used as a deoxidizing agent for the melting process. This element is combined with nitrogen intruding during soft nitriding, thus effectively increasing both the surface hardness and the hardened depth. For these effects to be exhibited, the content of 0.02 wt % or more is required. When the Al content exceeds 0.30 wt %, the surface is formed with a firm soft nitride layer with a reduced hardened depth. In relation with other component elements, the content of this element was set to 0.07 to 0.13 wt % for the material 2.

Vanadium improves the hardenability and both the surface hardness and the hardened depth at the same time by combining N and C and thus depositing a fine vanadium carbide or nitride during nitriding. Particularly for its high contribution to an increased hardened depth, this element effectively improves the fatigue resistance. In order to develop the effect, the content is required to be 0.05 wt % or more. Meanwhile if the content exceeds 0.20 wt %, V is caused to combine with N content, thus depositing a rough vanadium nitride at the sacrifice of a deteriorated core tenacity. Therefore V content was set to the value ranging from 0.10 to 0.15 wt % for the material 2 in relation with contents of other component elements.

Nickel is an element effective for enhancing the tenacity. If Ni content exceeds 0.25 wt %, the machinability is deteriorated. Therefore, Ni content was set to 0.25 wt % or less for the material 2 in relation with contents of other component elements.

Copper gives only a little effect on the material strength. If Cu content exceeds 0.3 wt %, the nitriding characteristic is adversely affected. Therefore, Cu content was set to 0.3 wt % or less for the material 2 in relation with contents of other component elements.

Phosphorus and sulfur are elements for improving the machinability. For free cutting component, therefore, at least one element of P and S can be contained. Even when such element in excess of an upper limit is added, the machinability is not improved, but instead the tenacity is reduced. Therefore the P content was set to 0.03 wt % or less and S content was set to 0.03 wt % or less.

The material 1 does not contain Al, V and Ni. The material 1 has lower tenacity than that of the material 2 owing to lack of Ni. However the material 1 has higher machinability and lower surface hardness than that of the material 2 owing to lack of Al and V serving to facilitate nitriding. However, the material 1 can be nitrided at relatively a lower temperature for a relatively short period. Additionally as it is formed of a low carbon steel, a thin compound layer can be formed and diffusion layer can be penetrated comparatively deeply.

Figure 2:
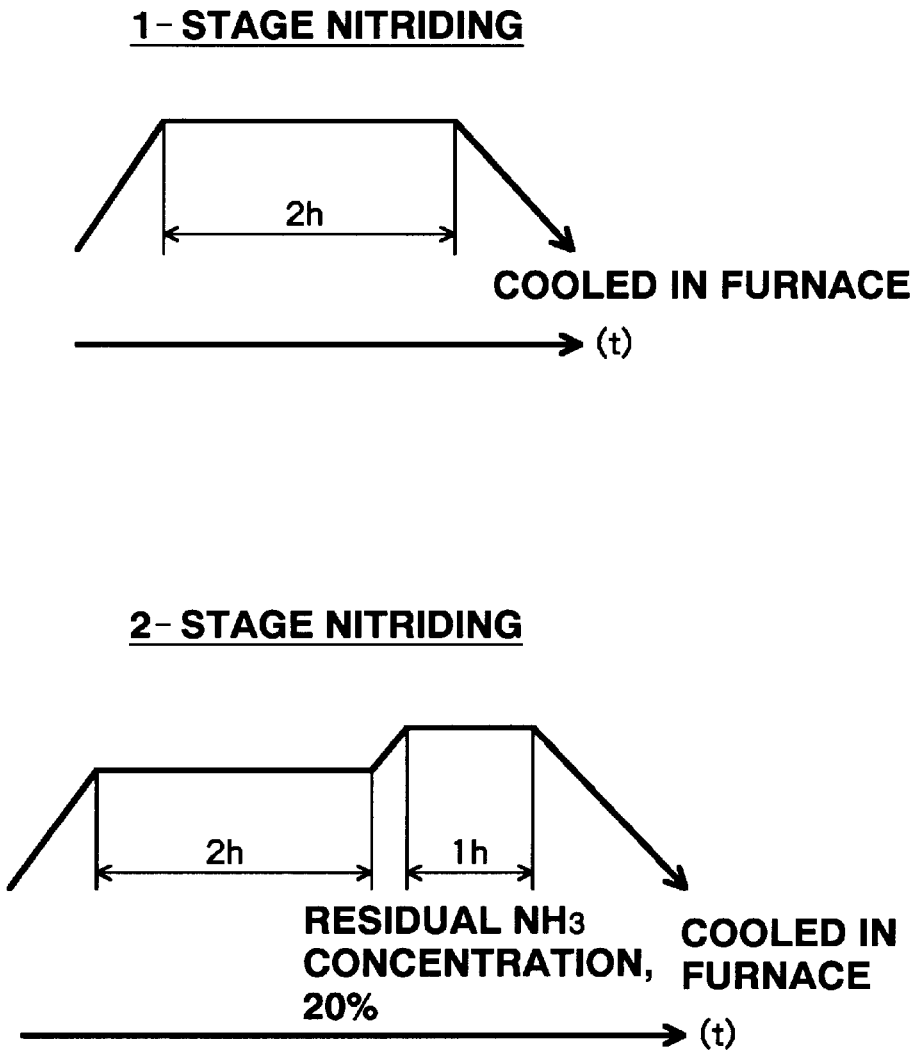
FIG. 2 is a diagram showing a method of an experiment conducted according to a gas soft nitriding method.

FIG. 2 shows methods of experiments for conducting 1-stage nitriding for 2 hours (1.5 hours for some cases) and 2-stage nitriding where an additional nitriding process for 1 hour (residual $NH_3$ concentration: 20 volume %) is combined with the 1-stage nitriding at different gas temperature and different residual $NH_3$ concentrations.

FIG. 3 is a Table showing results of the experiments where the material 1 containing the elements shown in Table 1 was gas-nitrided under various conditions. The thickness of the compound layer was set to 12 $\mu$m or less. The hardness of the diffusion layer was set to be equal to or higher than the inside hardness (hardness of the heat treated stock) plus Hv 50 and thickness was set to 200 $\mu$m or more.

As a result, a satisfactory product is obtained at the residual $NH_3$ concentration of 52 to 60 volume % and the gas temperature of 550 to 560° C. In particular, the most satisfactory product can be obtained at the residual $NH_3$ concentration of 50 to 55% and the gas temperature of 560° C.

FIG. 4 is a Table showing results of the experiments where the material 2 containing the elements shown in Table 2 was gas soft nitrided under various conditions. The thickness of the compound layer was likewise set to 12 $\mu$m or less. The hardness of the diffusion layer was set to be equal to or higher than the inside hardness (hardness of heat treated Jock) plus Hv 5 and the thickness was set to 200 $\mu$m or more.

Consequently, a satisfactory product was obtained at the residual $NH_3$ concentration of 52 to 60 volume % and the gas temperature of 550 to 570° C. In particular, the most satisfactory product can be obtained at the residual $NH_3$ concentration of 55 to 60 volume % and the gas temperature of 550° C.

What is claimed is:

1. A gear formed by gas soft nitriding a steel consisting essentially of, by weight %, 0.18 to 0.23 of C, 0.15 to 0.35 of Si, 0.60 to 0.85 of Mn, 0.03 or less of P, 0.03 or less of S, 0.90 to 1.20 of Cr and 0.15 to 0.30 of Mo, with Fe and impurities as a residual, wherein said gear comprises a compound layer containing N and Fe having a thickness of 2 to 12 $\mu$m on a tooth flank surface thereof and a diffusion layer formed under said compound layer having a thickness of 200 $\mu$m or more and having a hardness equal to or higher than that of said steel plus Hv 50, wherein said gear is formed by:

forming a gear stock of said steel; and soft nitriding said gear stock in a mixture gas atmosphere containing 50 to 60 volume % of residual $NH_3$ at a gas temperature of 550 to 560° C.

2. A gear formed by gas soft nitriding a steel consisting essentially of, by weight %, 0.16 to 0.21 of C, 0.15 to 0.35 of Si, 0.55 to 0.90 of Mn, 0.03 or less of P, 0.03 or less of S, 0.3 or less of Cu, 0.25 or less of Ni, 0.90 to 1.10 of Cr, 0.07 to 0.13 of Al and 0.10 to 0.15 of V, with Fe and impurities as a residual, wherein said gear comprises a compound layer containing N and Fe having a thickness of 2 to 12 $\mu$m on a tooth flank surface thereof and a diffusion layer formed under said compound layer having a thickness of 200 $\mu$m or more and having a hardness equal to or higher than that of said steel plus Hv 50, wherein said gear is formed by:

forming a gear stock of said steel; and soft nitriding said gear stock in a mixture gas atmosphere containing 52 to 60 volume % of residual $NH_3$ at a gas temperature of 550 to 570° C.

3. The gear according to claim 1, wherein said gear is used for an automatic transmission.

4. The gear according to claim 3, wherein said gear is coupled to an input shaft or an output shaft of a planetary gear unit of said automatic transmission.

5. A method of fabricating a gear, comprising the steps of:

forming a gear stock of steel consisting essentially of, by weight %, 0.18 to 0.23 of C, 0.15 to 0.35 of Si, 0.60 to 0.85 of Mn, 0.03 or less of P, 0.03 or less of S, 0.90 to 1.20 of Cr and 0.15 to 0.30 of Mo, with Fe and impurities as residual; and soft nitriding said gear stock in a mixture gas atmosphere containing 50 to 60 volume % of residual $NH_3$ at a gas temperature of 550 to 560° C.

6. The method of fabricating a gear according to claim 5, wherein residual $NH_3$ concentration of said mixture gas ranges from 45 to 60 volume % and gas temperature ranges from 555 to 565° C.

7. The method of fabricating a gear according to claim 5, comprising the steps of:

first-stage soft nitriding in said mixture gas containing 55 to 65 volume % of residual $NH_3$ at temperature of 545 to 555° C.; and second-stage soft nitriding in said mixture gas containing 15 to 25 volume % of residual $NH_3$ at gas temperature of 585 to 595° C.

8. A method of fabricating a gear, comprising the steps of:

forming a gear stock of a steel consisting essentially of, by weight %, 0.16 to 0.21 of C, 0.15 to 0.35 of Si, 0.55 to 0.90 of Mn, 0.03 or less of P, 0.03 or less of S, 0.3 or less of Cu, 0.25 or less of Ni, 0.90 to 1.10 of Cr, 0.07 to 0.13 of Al and 0.10 to 0.15 of V, with Fe and impurities as residual; and soft nitriding said gear stock in a mixture gas atmosphere containing 52 to 60 volume % of residual $NH_3$ at temperature of 550 to 570° C.

9. The method of fabricating a gear according to claim 8, comprising the steps of:

first-stage soft nitriding in said mixture gas containing 50 to 60 volume % of residual $NH_3$ at temperature of 540 to 560° C.; and second-stage soft nitriding in said mixture gas containing 15 to 25 volume % of residual $NH_3$ at temperature of 585 to 595° C.

10. The gear according to claim 2, wherein said gear is used for an automatic transmission.

11. The gear according to claim 10, wherein said gear is coupled to an input shaft or an output shaft of a planetary gear unit of said automatic transmission.

12. The gear according to claim 1, wherein said steel contains at least one of P and S.

13. The gear according to claim 2, wherein said steel contains at least one of P and S.

14. The method of fabricating a gear according to claim 5, wherein said steel contains at least one of P and S.

15. The method of fabricating a gear according to claim 8, wherein said steel contains at least one of P and S.

16. The gear according to claim 2, wherein said steel contains at least one of Cu and Ni.

17. The gear according to claim 2, wherein said steel contains both of Cu and Ni.

18. The method of fabricating a gear according to claim 8, wherein said steel contains at least one of Cu and Ni.

19. The method of fabricating a gear according to claim 8, wherein said steel contains both of Cu and Ni.

* * * * *